United States Patent [19]

Lin

[11] Patent Number: 4,768,670

[45] Date of Patent: Sep. 6, 1988

[54] COMBINATIONAL DUMP CONTAINERS

[75] Inventor: Chuang-Sheng Lin, Taichung City, Taiwan

[73] Assignee: Vie Transportation Co., Ltd., Taichung City, Taiwan

[21] Appl. No.: 111,726

[22] Filed: Oct. 22, 1987

[51] Int. Cl.[4] ..... B65D 90/00

[52] U.S. Cl. ..... 220/1 T; 232/43.1

[58] Field of Search ..... 220/1 T, 1.5, 1 V, 85 R; 232/43.1, 43.2, 43.3, 43.4, 43.5

[56] References Cited

U.S. PATENT DOCUMENTS

| | | | |
|---|---|---|---|
| 4,290,352 | 9/1981 | Schmidt et al. | 220/1 T |
| 4,406,395 | 9/1983 | Scoggins | 232/43.1 |
| 4,545,523 | 10/1985 | Galbreath et al. | 232/43.1 |
| 4,609,117 | 9/1986 | Pamment | 220/1 T |
| 4,615,454 | 10/1986 | Verhoog, Jr. | 220/1 T |
| 4,676,431 | 6/1987 | Teske et al. | 232/43.1 |
| 4,687,405 | 8/1987 | Olney | 220/1 T |
| 4,714,168 | 12/1987 | Johnson et al. | 220/1 T |

*Primary Examiner*—Joseph Man-Fu Moy

*Attorney, Agent, or Firm*—Browdy and Neimark

[57] ABSTRACT

The present disclosure is concerned with combinational dump containers which consist of a major dump container and at least a minor garbage collector which is structured in a close form with flap covers openably controlled by foot-actuated devices, and an automatic garbage discharge outlet disposed at the bottom of the minor garbage collector, which can work in cooperation with an opening unit of the major dump container as well as an anti-dust cover thereof, therefore the minor garbage collector, lifted up by a hoist unit, can dump all the garbage therein into the major dump container carried by a truck when the automatic garbage discharge outlet is actuated by the opening unit.

6 Claims, 2 Drawing Sheets

FIG.1-A

COMBINATIONAL DUMP CONTAINERS

BACKGROUND OF THE INVENTION

The present invention relates to a combination of dump containers which include a major dump container carried by a heavy truck, and at least a minor garbage collector located at a particular place for collecting garbage dumped by the public; the minor garbage collecting container is equipped with a number of flap covers controlled by foot-actuated devices and an automatic garbage discharge outlet for readily discharging or unloading the collected garbage therein into said major dump container having an opening unit for opening said discharge outlet of said minor garbage collector so that the garbage collecting task can be completed in a ready, fast, clean and hygienic manner. Moreover, an anti-dust cover is disposed on the top of said major dump container for preventing the dust or dirt from flying out thereof in a dumping process.

In most of the big modern cities all over the world, garbage has been collected by way of using a plurality of garbage collecting containers distributed at particular convenient places in the cities where the public can dump the garbage into there, and the containers are then picked up and discharged of the contents therein, by hoist means mounted on trucks, into major dump containers carried by the same trucks, then the trucks are driven to the dump lot where the garbages are dumped for processing by burning, covering or other methods.

In general, the distributedly located minor garbage collecting containers are constantly exposed to the sun and rain without covers, thus causing bad smell or oder easily, especially in hot days, as a result of the decomposition process of the garbage contianed therein; moreover, the unhygienic containers can attract mosquitoes and flies and insects of the like in summer days. However some of those collecting containers have been provided with covers to avoid some above-cited problems. Those types of covers are generally opened by hands and often left unclosed by people, therefore the function of these covers can not fully meet the original expectation; moreover, the covers are not easy to opeh for people holding with two hands the garbage bags. Another disadvantage associated with the conventional minor garbage colecting containers lies in that when these containers are lifted up to dump the garbage therein out, the attached covers have to be removed or opened first, thus causing the operational inconvenience to such extent that the discharging process can be slowed down.

Therefore, the primary object of the present invention is to provide an improved combinational dump containers which include a major dump container and at least a minor garbage collecting container which is structured in a close form and provided with a number of flap covers actuated by foot-operated devices mounted on both sides thereof, and at the V-shaped bottom of said minor container, a pair of automatically operated garbage discharge outlets are disposed, which is structured to operate in cooperation with the outlet-opening unit and the anti-dust covers, both disposed on the top of said major dump container so that the collection of garbage can be carried out in an easier, faster and cleaner way.

One further object of the present invention is to provide an improved combinational dump containers wherein said minor garbage collecting container is provided with foot-actuated flap covers which are all controlled by a foot actuated device including an elongate step rod, a drive axis, linking rods and supporting members, and the flap covers can be opened by simple actuation of the step rods disposed externally on both sides of the containers.

One further object of the present invention is to provide an improved combinational dump containers wherein the garbage discharge outlets disposed at the V-shaped bottom of said minor garbage collecting container, consists of a pair of covers on each side of the V-shaped bottom, one being fixed in place and the other being slidably opened with respect to the other; said fixed cover is made in a double-layer form so that the slidable cover can be received therein when pushed open; a push rod is disposed on each side of said slidable cover and slidably located in an elongated trough against a spring so that the cover can be pushed opened and instantly closed as a result of the help of said spring in operation.

One still further object of the pressent invention is to provide an improved combinational dump containers wherein a cover-opening unit, consisting of a pair of elongated troughs disposed on each side wall of the raised box-like intakes of said major dump container and shaped in a reverse V configuration so that the push rods mounted on both the sides of said slidable cover disposed on the bottom of said monor garbage-collecting container can slidably engage in said reverse V-shaped troughs so to push said slidable cover open for discharging the garbage therein into said major dump container carried by a movearound truck.

It is yet another object of the present invention to provide an improved combinational dump containers, wherein said raised box-like intakes are furnished with a number of splited and flexible rubber pieces which form an anti-dust cover at the opening of said intakes of said major dump container, said flexible pieces are made of rubber having high elasticity so that the same can resume from a bent position to a horizqntal position for closing the opening when said minor garbage collecting container is removed from the said intake.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE PREFERRED EMBODIMENT

Figure 1:
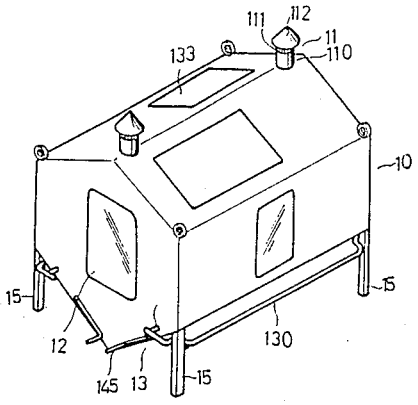
FIG. 1 is a diagram showing the perspective structure of the minor garbage collecting container.
Figure 2:
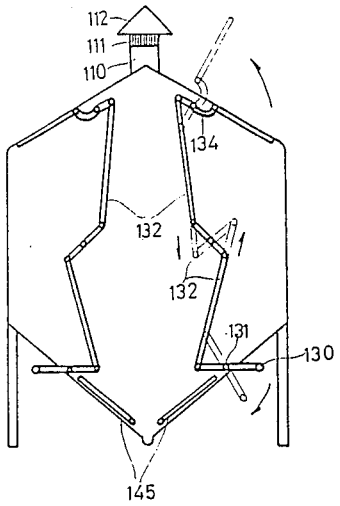
FIG. 2 is a diagram showing the mechainsm of the foot-actuated flap cover of the minor garbage collecting container.

Refer first to FIG. 1, the minor garbage collecting container 10 of the present combinational dump containers is structured in a close form and mainly consists of a pair of ventilators 11 disposed on the middle of the gable roof-like top thereof and communicating with the interior of said container 10 by way of a pipe 110 which is provided with an umbrella-shaped shelter for stopping rain from coming into said container, and a wind-operated air drawer 111 for effecting good ventilation in the closed container, avoiding high temperature created therein so to alleviate bad odor of the garbage therein to the minimum extent; a number of transparent plates 12 disposed on the side walls of said container 10 for permitting people to check the condition of the collected garbage therein; a foot-actuated flap cover opening mechanism 13 disposed adjacent to both the side walls of said minor garbage collecting container 10 as shown in FIG. 2, consists of an elongated foot actuated step rod 130, a drive axis 131, located through the side wall thereof, and a number of links 132, and cover-supporting members 134 disposed under said flap covers 133; on actuating said step rod 130, said drive axis 131 is twisted by a torque to rotate so to make said links 132 move accordingly, thus said flap cover 133 is opened with ease, and can be closed by its own weight as long as the step rod 130 is free of actuation. Refer to FIG. 1A, along the two opposite sides of said flap cover 133, there are provided with a pair of plastic pads 135 for tightly sealing said garbage collecting container 10.

Figure 3:
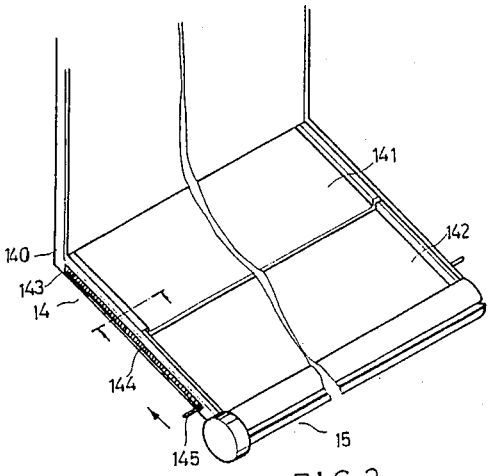
FIG. 3 is a diagram showing the structure of the bevel bottom of the minor container with a fixed cover and a slidable cover.

An automatically operated discharge outlet 14 as shown in FIG. 3 is disposed on the V-shaped bottom of said minor garbage-collecting container 10, extending the full length thereof, said discharge outlet 14 comprises of a fixed cover 141 in double-layer form for receiving a slidable cover 142 therein when the same is actuated to open; a side bracket 140 is disposed along the edge of the side wall joining one side of said V-shaped bottom, and a trough 143 is defined on the bracket 140 for receiving an elongate spring element 144 therein so that said slidable cover 142 can be pushed open with the push rod 145 disposed on each side thereof moving against spring element 144 and be closed by resilient force thereof when said push rod 145 is free of actuation. The garbage collected therein can be dumped through the opened discharge outlet owing to gravity.

Figure 4:
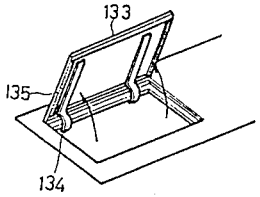
FIG. 4 is a diagram showing the partial structure of the water collecting unit and the edge of the slidable cover.
Figure 4:
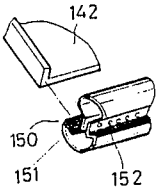
Figure 5:
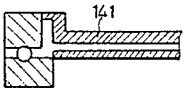
FIG. 5 is a sectional view of the double-layered fixed cover.
Figure 6:
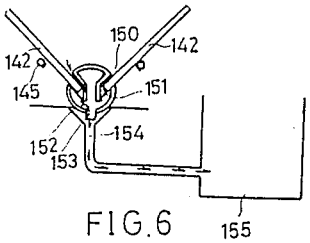
FIG. 6 is a sectional view showing the relation between the slidable covers and the water collecting unit.

A water collecting unit 15 is as shown in FIG. 4, and is located along the center ridge of the V-shaped bottom at where the two bevel sides of said bottom intersects. Said water collecting unit 15 is in a tubular form, and two elongated grooves 150, extending the whole length of said tubular water collecting unit 15, are disposed on both sides thereof, and said grooves are defined in the same inclination as the said V-shaped bottom as shown in FIG. 4 and FIG. 6. Disposed on the lower side of said grooves 150 is an elongate plastic pad 151, and a plurality of draining bores 152 are defined on the bottom of said grooves 150. The front edge of said slidable cover 142 is able to be engagably received in said grooves 150 as shown in FIG. 6.

Waste water in said container 10 can be collected in said elongate water collecting unit 15 via the draining bores 15Z, and an outlet port 153 is connected by a pipeline 154 to a sewer 155. Said slidable cover 142 is structured in a reinforced manner and has a vertically raised edge as shown in FIG. 4 so that waste water can be led smoothly to said water collecting unit 15.

Said pipeline 154 can be located under the ground as shown in FIG. 6 as long as said minor garbage collecting container 10 is located in a fixed place.

Figure 7:
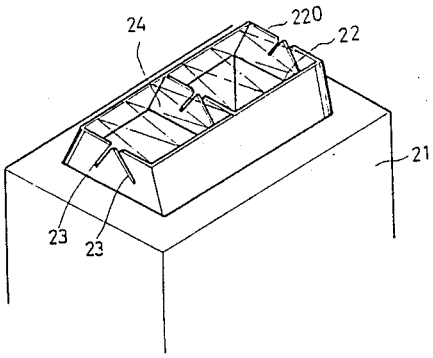
FIG. 7 is a diagram showing the structure of the intakes of the major dump container.
Figure 8:
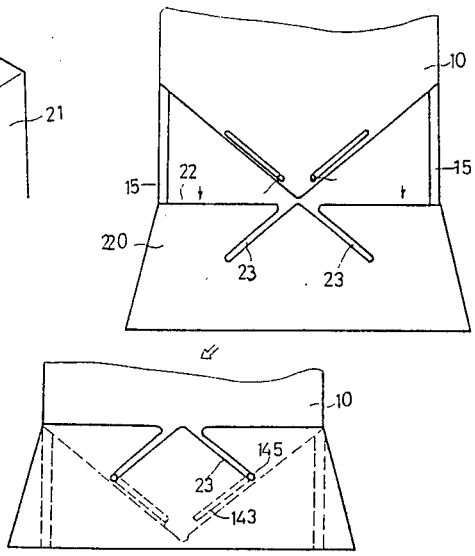
FIG. 8 is a combination diagram showing the minor garbage container being lifted up and located on top of the intake of said major dump container; and being lowered down partially into the same with the push rods in engagement with the reverse V shaped troughs disposed on the opposite side walls of the intakes.
Figure 9:
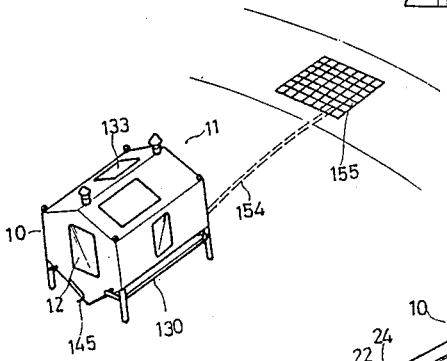
FIG. 9 is a diagram showing the bottom of the minor garbage collecting container being coupled to a sewer by a pipeline.
Figure 10:
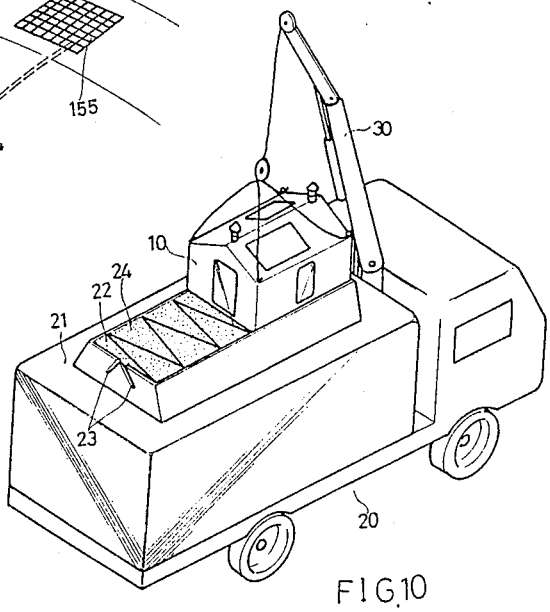
FIG. 10 is a diagram showing the minor garbage collecting container being lifted up and located on top of one of the intakes of the major dump container by a hoist means mounted on a truck.

Refer to FIG. 7, said major dump container 21 is provided with two garbage intakes 22 on the top thereof, the intakes 22 are provided with a high raised surrounding walls; on the opposite right and left walls thereof are defined a pair of elongated troughs 23, arranged in a reverse V-shaped configuration, and said push rods 145 are limited to slide therein when said minor garbage collecting container 10 is located on the top of said intake 22 so that said slidable cover 142 can be automatically opened thereby. A plurality of split and independent V-shaped plastic pieces 24 are mutually interposed in two oppositely placed zig-zag series in such a manner that they can define a full cover on the top of said intake 22, which can be automatically opened and closed with ease for preventing the dust of the collected garbage from flying out therefrom when garbage is dumped into said container.

The garbage collected in said minor garbage collecting container 10 can be dumped into said major dump container 21, carried by a truck 20, with the help of a hoist means 30 disposed on the same truck 20; garbage in said container 10 is discharged through the garbage discharge outlets 14 when said container 10 is located on the top of said major dump container 21 with the said discharge outlet 14 engaging with the opening of said intake 22 and said push rods 145 fitted in said troughs 23. Said push rods 145 are moved against the edges of said troughs 23 owing to the weight of said minor container 10 as the same is free of the lift force from said hoist means. When said minor container 10 is lifted up again by said hoist means 30, said push rods 145 are actuated by said spring elements 144 to move downward so to make said slidable covers 142 closed again; and said split rubber pieces 24 can resume from a bent state to a normal extended state, thus closing the opening of said intake 22.

What I claim is:

1. An improved combinational dump containers which include a major dump container and a plurality of minor garbage collecting containers wherein said minor garbage collecting container is structured in a close form and said major dump container is carried around by a truck which is provided with a hoist means for lifting up each said minor container for effecting the discharge of the garbage therein into said major dump container; on each of the two opposite sides of said minor container, a foot-actuated flap cover opening means being provided for ready opening the flap covers disposed on the top of said minor garbage collecting container; on the V-shaped bevel bottom of said minor garbage collecting container, a water collecting and draining means being disposed for draining waste water out therethrough; and a pair of elongate garbage discharge ports being disposed thereon which are provided with mechanically actuated cover means operated in cooperation with the cover opening means mounted on the side walls of the garbage intakes disposed ont he top of said major dump container and a plurality of flexible anti-dust pieces which are adapted to prevent the dust or dirt from flying out therefrom in the garbage dumping process so that garbage can be dumped in said minor garbage collecting container through the openings on the top thereof covered by said flap covers and be discharged through said discharge ports on the bevel bottom thereof into the major dump container when the same is lifted up and located in engagement with the top of said intake of said major dump container in a ready manner.

2. An improved combinational dump containers as set forth in claim 1, wherein said foot-actuated flap cover opening means, disposed on both the right and left sides of said minor garbage collecting container, consists of an elongate step rod, a drive axis, a number of linking rods forming a linkage and a pair of cover supporting members which are arranged in such a mechaincally operative manner that when said foot-actuated step rod is pushed downward by foot, the said flap cover is opened via the linkage mechanism and closed by its own weight as soon as said step rod is free of the actuation.

3. An improved combinational dump containers as set forth in claim 1, wherein a garbage discharge means is disposed on the V-shaped bevel bottom of said minor garbage collecting container; on each side of said V-shaped bottom, a fixed cover being disposed at the upper part thereof, joining the side wall of said minor garbage collecting container, said fixed cover being made in a double-layer form with a space formed therebetween; and a slidable cover being disposed at the lower part thereof, and next to said fixed cover, with a push rod attached on each side thereof, and located in an elongate trough and movably sliding against an elongate spring, said elongate trough being defined on the side bracket fixed on both the sides of said minor garbage collecting container; said slidable cover being slidably pushed open with said push rod moving against said elongate spring and said slidable door receivably moving into said space between said double-layer structure of said fixed cover so that the garbage in said minor container can be discharged through a port formed as a result of the opening of said slidable cover; and said port being able to be closed by said slidable cover as a result of the actuation of said spring on said push rod thereon.

4. An improved combinational dump containers as set forth in claim 1, wherein a water collecting and draining means is structured in a tubular form and disposed along the central ridge of said V-shaped bevel bottom of said minor garbage collecting container with the two opposite ends thereof fixed on each of said side brackets respectively; on both symmetric sides of the tubular body of said water collecting and draining meaning an elongated and three-sided trough being defined in such a manner that the edge of said slidable cover can be received therein, and an elongate plastic pad being disposed on the bottom side of said trough with a plurality of draining bores defining on the adjacent side of said pad-covered side.

5. An-improved combinational dump containers as set forth in claim 1, wherein a cover-opening means is disposed on both the opposite side walls of the garbage intake disposed on the top of said major dump container, which is comprised of a pair of elongate reverse V-shaped troughs into which said push rods on the sides of said slidable covers are movably located and are pushed moving against said elongate springs due to the weight of said minor garbage collecting container when the same is lifted up and located on right top of one of said garbage intakes and free of the hoist means.

6. An improved combinational dump containers as set forth in claim 1, wherein a number of split and independent V-shaped rubber pieces are disposed in two opposite zig-zag series which are fitly interposed between each other so to form a full cover on top of said intake for preventing duct or dirt in said minor garbage container from gushing out thereof, said rubber pieces being made of the material with high elasticity so that they can resume a covering position from a bent position easily and quickly.

* * * * *